United States Patent [19]

Terauchi et al.

[11] 4,387,659

[45] Jun. 14, 1983

[54] DEVICE FOR ENGAGING AND DISENGAGING CABLE

[75] Inventors: Kazuo Terauchi, Sakai; Masatoshi Fukata, Ohtsu, both of Japan

[73] Assignee: Hitachi Shipbuilding & Engineering Co., Ltd., Osaka, Japan

[21] Appl. No.: 277,059

[22] Filed: Jun. 24, 1981

[30] Foreign Application Priority Data

Jul. 18, 1980 [JP] Japan ..... 55-102566

[51] Int. Cl.[3] ..... B63B 21/08

[52] U.S. Cl. ..... 114/199; 114/249; 114/230

[58] Field of Search ..... 114/199, 218, 230, 213-217, 114/249, 251, 252, 242, 247, 253; 254/329, 254/335-336, 391

[56] References Cited

U.S. PATENT DOCUMENTS 106,514 8/1870 Shipman ..... 114/252

FOREIGN PATENT DOCUMENTS 779166 11/1980 U.S.S.R. ..... 114/218

OTHER PUBLICATIONS

Japanese Published Examined Patent Application Number 51-35755 Applicant: Japan National Railway-Publication Date: Oct. 4, 1976, Summary.

*Primary Examiner*—Charles E. Frankfort
*Assistant Examiner*—Jesús D. Sotelo
*Attorney, Agent, or Firm*—Barnes, Kisselle, Raisch, Choate, Whittemore & Hulbert

[57] ABSTRACT

A device for engaging and disengaging a line comprising a pair of pivotal arms turnable to an upright position and to a horizontal position and supported at a location close to a line engaging bitt opposed to and a distance away from a line guiding member, a pressing traverse arm extending between the free ends of the pivotal arms, a disengaging traverse arm extending between intermediate portions of the pivotal arms for disengaging the line from the bitt, apparatus for turning the pivotal arms to the upright position and to the horizontal position, and a pressing bed positioned to oppose the pressing traverse arm when the pivotal arms are turned to the horizontal position, the disengaging traverse arm being positionable above the bitt when the pivotal arms are in the upright position, the traverse arms and the pivotal arms defining a space for inserting the line therethrough. The line can be engaged with and disengaged from the bitt or bollard easily and properly. While the line is in engagement with the bollard, the pressing traverse arm presses the line against the bed. This eliminates the likelihood that the line will disengage from the bollard when the ship pitches or rolls and also permits use of low bitts or bollards.

1 Claim, 3 Drawing Figures

DEVICE FOR ENGAGING AND DISENGAGING CABLE

The present invention relates to a device for engaging and disengaging cables, for example, for engaging a tug line or mooring line with a bitt or bollard and disengaging the line therefrom when the line is used for towing or mooring a ship.

Tug lines and mooring lines generally used for ships are difficult to handle since they have a large diameter and are heavy and not flexible. Accordingly when such a line is engaged with or disengaged from a bollard or bitt manually, the procedure requires much time and many workers, hence uneconomical. For this reason, automatic line engaging and disengaging devices have heretofore been provided. To be sure, these devices facilitate disengagement of the line from a bollard or bitt, but they still involve difficulty in engaging the line since the engaging portion of the line deforms when the line is to be engaged while being pulled by a messenger rope at this portion.

The main object of the present invention, which has been accomplished in view of the above situation, is to provide a device by which a line can be engaged with and disengaged from a bitt easily and properly at all times.

To fulfill this object, the invention provides a device for engaging and disengaging a line comprising a pair of pivotal arms turnable to an upright position and to a horizontal position and supported at a location close to a line engaging bitt opposed to and a distance away from a line guiding member, a pressing traverse arm extending between the free ends of the pivotal arms, a disengaging traverse arm extending between intermediate portions of the pivotal arms for disengaging the line from the bitt, means for turning the pivotal arms to the upright position and to the horizontal position, and a pressure bed positioned to oppose the pressing traverse arm when the pivotal arms are turned to the horizontal position, the disengaging traverse arm being positionable above the bitt when the pivotal arms are in the upright position, the traverse arms and the pivotal arms defining a space for inserting the line therethrough.

With the apparatus of the construction described above, the line is pulled in through the line guiding member and the line inserting space when the pivotal arms are in the upright position, so that the line, in whatever direction it may be pulled in, can be oriented and positioned first definitely relative to the bitt and then engaged with the bitt properly when the pivotal arms are subsequently turned to the horizontal position. The line in engagement with the bitt is firmly held against the pressing bed by the pressing traverse arm. This prevents the line from accidentally disengaging from the bitt even when the ship rolls or pitches and further makes it possible to use a low bitt. Since the disengaging traverse arm is brought to a position above the bitt when the pivotal arms are turned to the upright position, the line is disengageable from the bitt automatically merely by turning the pivotal arms upright.

According to a preferred embodiment of the invention, the engaging bitt has a tapered top. While the line is automatically disengageable from the bitt, this renders the line engageable therewith also without necessitating any manual procedure.

These and other features and advantages of the invention will become apparent from the embodiment to be described below with reference to the accompanying drawings, in which.

Figure 1:
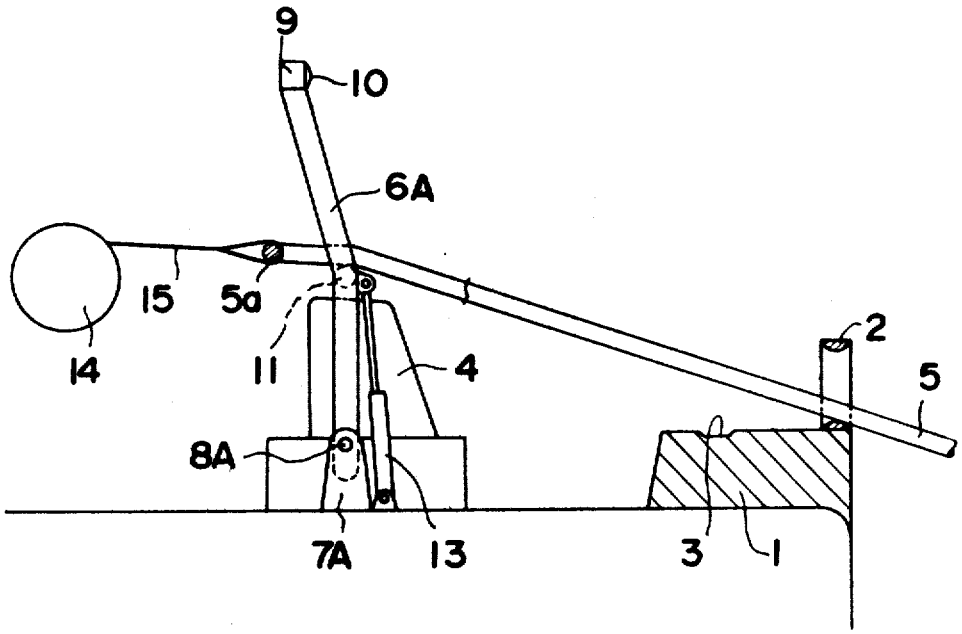
FIG. 1 is a side elevation partly in section and showing an embodiment of the invention immediately before a line is engaged with a bitt.

With reference to the drawings, a holding bed 1 provided on a deck close to a gunwale has a line guiding member 2 positioned upright thereon closer to the gunwale and is formed with a recess 3 of certain width inwardly of the guiding member 2. Opposed to the guiding member 2 is an upstanding engaging bitt 4 disposed closer to the center of the ship and having a frustoconical shape for smoothly releasing an eye splice 5*a* of a tub line 5. The top of the bitt 4 has no sidewise projection.

A pair of pivotal arms 6A, 6B supported at a location close to the engaging bitt 4 is disposed between the guiding member 2 and the engaging bitt 4 and is turnable to an upright position and to a horizontal position. More specifically stated, the base ends of the pivotal arms 6A, 6B are pivoted respectively by lateral pins 8A, 8B to brackets 7A, 7B on the opposite sides of the bitt 4. The pivotal arms 6A, 6B have a pressing traverse arm 9 extending between their free ends. A pressing member 10 of rubber or the like is attached to the pressing side of the traverse arm 9 for giving increased friction. The pivotal arms 6A, 6B further have a disengaging traverse arm 11 between intermediate portions thereof. The disengaging traverse arm 11 is adapted to be positioned above the engaging bitt 4 when the pivotal arms 6A, 6B are turned to the upright position. To render the tug line 5 smoothly disengageable from the traverse arm 11, the arm 11 is circular in cross section. By the arrangement described above, the traverse arms 9, 11 and the pivotal arms 6A, 6B define a space 12 for inserting the line therethrough. The pivotal arms 6A, 6B are turned by cylinder means which is of the hydraulic or pneumatic type. Indicated at 14 is a winch, and at 15 a messenger rope.

The device will be used in the following manner. First, the cylinder means 13 is extended to raise the pivotal arms 6A, 6B to the upright position. The messenger rope 15 from the winch 14 is inserted through the space 12 and the guiding member 2 and delivered to a tugboat, on which the messenger rope 15 is tied to the eye splice 5*a* of the tug line 5. The winch 14 is then operated to pull up the messenger rope onto the ship, whereby the tug line 15 is also hauled aboard through the guiding member 2 and the space 12 as shown in FIG. 1.

Figure 2:
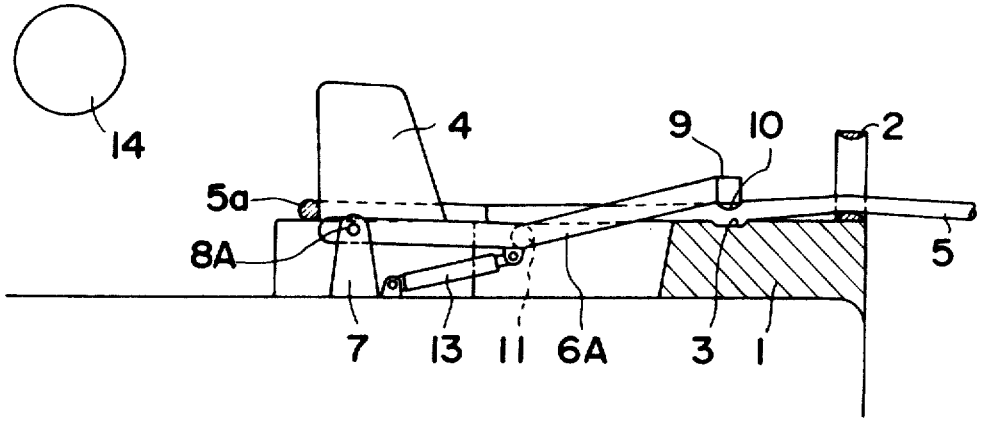
FIG. 2 is a side elevation partly in section and showing the same embodiment when the line is in engagement with the bitt.
Figure 3:
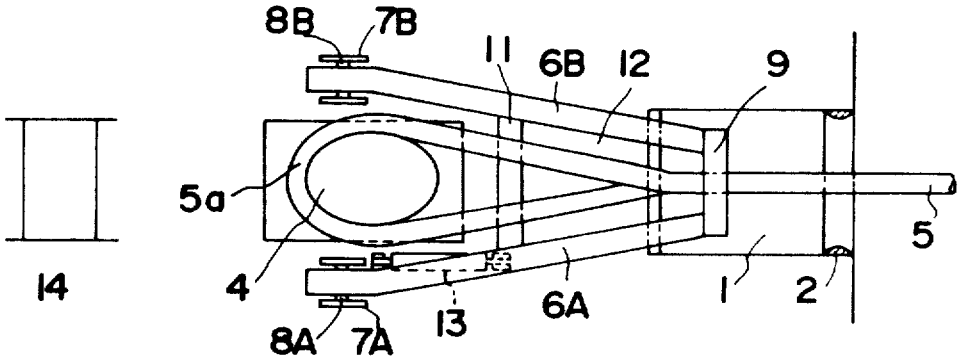
FIG. 3 is a plan view of FIG. 2.

Subsequently the cylinder means 13 is contracted to turn the pivotal arms 6A, 6B to the horizontal position and cause the pressing traverse arm 9 to press the tug line 5 against the holding bed 1. More specifically the tug line 5 is held in the recess 3 by the pressing member 10 firmly with the increased friction. The winch 14 is thereafter slightly loosened. This will not permit the tug line 5 to slip off the place since it is held by the pressing traverse arm 9. The eye splice 5*a* is then engaged with the bitt 4 by the worker or by suitable means, and the messenger rope 15 is disconnected from the tug line 5. The pressure on the cylinder means 13 is now lessened to free the pivotal arms 6A, 6B, whereupon the eye splice 5*a* is completely held by the bitt 4 in the state shown in FIGS. 2 and 3. Since the tug line 5 in this state is pressed on at all times by the gravity acting on the pivotal arms 6A, 6B and on the two traverse arms 9, 11, the tug line 5 is prevented from being forced up and removed from the bitt 4 by the movement of the tugboat as well as of the ship.

When the tug line 5 is to be disengaged from the engaging bitt 4, the cylinder means 13 is stretched to turn the pivotal arms 6A, 6B to their upright position, thereby causing the disengaging traverse arm 11 to lift the eye splice 5*a*. Since the disengaging traverse arm 11 is brought to a higher level than the engaging bitt 4 at this time, the eye splice 5*a* can be automatically disengaged from the bitt 4. The tug line 5 is released from the present device by gravity properly through the space 12 by being guided by the space defining arms.

Although the holding bed 1 is illustrated as being located beneath the line guiding member 2, this arrangement is not always essential, provided that the holding bed 1 is so positioned as to oppose the pressing traverse arm 9 when the pivotal arms 6A, 6B are turned to the horizontal position. Thus the bed 1 may be positioned away from the guiding member 2, or may be integral with the base for the bitt 4.

According to the present embodiment, the pivotal arms 6A, 6B are provided with knucles, i.e. the arms 6A, 6B are slightly bent at intermediate portions thereof so that great tension, even when acting on the tug line 5 in its engaged position, will not be delivered to the arms 6A, 6B.

While the eye splice 5*a* of the tub line 5 has been described above as being engaged with the bitt 4 by the worker or by suitable means, the eye splice 5*a* is made automatically engageable with the bitt 4 when the pivotal arms 6A, 6B are turned to the horizontal position, if the top portion of the bitt 4 is made further smaller.

Although unillustrated, the present device can be provided with the following expedients.

(1) A guide disposed to the rear of the bitt 4 for the messenger rope 15 so that the rope 15 can be wound up in a definite direction to assure automatic engagement more reliably.

(2) A guide plate for the tug line 5 (eye splice 5*a*) provided close to the disengaging traverse arm 11 in the space on one side thereof opposite to the line inserting space 12 so that the tug line 5 can be guided through the space 12 more smoothly and reliably.

(3) Corner guides provided at two corners of the line inserting space 12 and attached to the junctions of the disengaging traverse arm 11 with the pivotal arms 6A, 6B for permitting the eye splice 5*a* to smoothly pass through the space 12.

(4) An opening formed by partly cutting one of the pressing traverse arm 9 and pivotal arms 6A, 6B for passing the messenger rope 15 therethrough into the line inserting space 12 so that when the rope 15 paid off is to be tied to the eye splice 5*a*, the rope 15 is tied to the splice 5*a* first without passing through the space 12 and then inserted through the opening into the space 12 for winding up to save the labor.

What is claimed is:

1. A device for engaging and disengaging a line comprising a pair of pivotal arms turnable to an upright position and to a horizontal position and supported at a location close to a line engaging bitt opposed to and a distance away from a line guiding member, a pressing traverse arm extending between the free ends of the pivotal arms, a disengaging traverse arm extending between intermediate portions of the pivotal arms for disengaging the line from the bitt, means for turning the pivotal arms to the upright position and to the horizontal position, and a pressing bed positioned to oppose the pressing traverse arm when the pivotal arms are turned to the horizontal position, the disengaging traverse arm being positionable above the bitt when the pivotal arms are in the upright position, the traverse arms and the pivotal arms defining a space for inserting the line therethrough.

* * * * *